US012441578B2

(12) United States Patent
Uchida

(10) Patent No.: US 12,441,578 B2
(45) Date of Patent: Oct. 14, 2025

(54) SHEET STACKING DEVICE, IMAGE FORMING APPARATUS, CONTROL METHOD, AND RECORDING MEDIUM

(71) Applicant: Eri Uchida, Kanagawa (JP)

(72) Inventor: Eri Uchida, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 167 days.

(21) Appl. No.: 18/503,594

(22) Filed: Nov. 7, 2023

(65) Prior Publication Data

US 2024/0174469 A1 May 30, 2024

(30) Foreign Application Priority Data

Nov. 30, 2022 (JP) ..... 2022-192478

(51) Int. Cl.

| | |
|---|---|
| ***B65H 43/04*** | (2006.01) |
| ***B65H 31/10*** | (2006.01) |
| ***B65H 31/18*** | (2006.01) |
| ***B65H 43/08*** | (2006.01) |

(52) U.S. Cl.

CPC ..... *B65H 43/04* (2013.01); *B65H 31/10* (2013.01); *B65H 31/18* (2013.01); *B65H 43/08* (2013.01); *B65H 2801/03* (2013.01)

(58) Field of Classification Search

CPC ..... B65H 31/04; B65H 31/08; B65H 31/10; B65H 31/18; B65H 43/04; B65H 43/06; B65H 43/08; B65H 2511/15

See application file for complete search history.

(56) References Cited

U.S. PATENT DOCUMENTS

| | | | | |
|---|---|---|---|---|
| 2015/0166292 | A1* | 6/2015 | Sekizuka | B65H 43/06 271/214 |
| 2015/0307308 | A1* | 10/2015 | Ando | B65H 31/18 271/215 |
| 2019/0283998 | A1 | 9/2019 | Uchida et al. | |
| 2020/0299090 | A1* | 9/2020 | Uchida | B65H 1/14 |
| 2021/0061600 | A1 | 3/2021 | Uchida | |
| 2022/0043385 | A1* | 2/2022 | Furukawa | B65H 31/10 |

FOREIGN PATENT DOCUMENTS

| | | |
|---|---|---|
| JP | 2005-104683 A | 4/2005 |
| JP | 2012-188226 A | 10/2012 |
| JP | 2020-152506 A | 9/2020 |

* cited by examiner

*Primary Examiner* — Prasad V Gokhale
(74) *Attorney, Agent, or Firm* — Harness, Dickey & Pierce, P.L.C.

(57) ABSTRACT

A sheet stacking device includes: a mounting table on which a pallet is mounted, the mounting table having a lift; a sensor including: light emitters and light receivers each arranged in the lateral direction of the sheet stacking device so as to face with each other, the sensor to detect at least one of an upper surface of sheets stacked on the pallet or an upper surface of the pallet; and circuitry configured to cause the lift to lower the mounting table by a predetermined amount in response to the sensor detecting the at least one of the upper surface of the sheets or the upper surface of the pallet, and to determine that the sheets have been stacked abnormally when the sensor is not in a non-detection state after the mounting table has been lowered by the predetermined amount.

7 Claims, 12 Drawing Sheets

SHEET STACKING DEVICE, IMAGE FORMING APPARATUS, CONTROL METHOD, AND RECORDING MEDIUM

CROSS-REFERENCE TO RELATED APPLICATIONS

This patent application is based on and claims priority pursuant to 35 U.S.C. § 119(a) to Japanese Patent Application No. 2022-192478, filed on Nov. 30, 2022, in the Japan Patent Office, the entire disclosure of which is hereby incorporated by reference herein.

BACKGROUND

Technical Field

Embodiments of the present disclosure relate to a sheet stacking device, an image forming apparatus, a control method, and a recording medium.

Related Art

In a sheet stacking device (hereinafter referred to as a "stacking tray"), a sheet material (e.g., a sheet (a sheet of paper), a recording sheet, or a sheet-shaped recording material) conveyed to the sheet stacking device curls may curl and be abnormally stacked. If sheet materials continue to be stacked while such abnormal stacking occurs, many defective sheets that are not stacked normally may be generated. Moreover, an abnormally stacked sheet material (a sheet that has been stacked inappropriately) may possibly cause a sheet jam in the sheet stacking device, generating abnormalities in the sheet stacking device. Therefore, early detection of abnormal stacking is an important technique for the stacking tray. Accordingly, a technique has been developed that detects abnormal stacking in the stacking tray. In such a technique, range sensors are disposed on an upper part of the stacking tray to monitor the distance from the range sensors to an upper surface of stacked sheets.

SUMMARY

Example embodiments include a sheet stacking device including: a mounting table on which a pallet is mounted, the mounting table having a lift; a sensor including: light emitters and light receivers each arranged in the lateral direction of the sheet stacking device so as to face with each other, the sensor to detect at least one of an upper surface of sheets stacked on the pallet or an upper surface of the pallet; and circuitry to cause the lift to lower the mounting table by a predetermined amount in response to the sensor detecting the at least one of the upper surface of the sheets or the upper surface of the pallet, and to determine that the sheets have been stacked abnormally when the sensor is not in a non-detection state after the mounting table has been lowered by the predetermined amount.

Example embodiments include a method of controlling a sheet stacking device, the sheet stacking device including a mounting table on which a pallet is mounted, the mounting table having a lift, the method including: detecting, by a sensor, at least one of an upper surface of sheets stacked on the pallet or an upper surface of the pallet, the sensor including light emitters and light receivers each arranged in the lateral direction of the sheet stacking device so as to face with each other; causing the lift to lower the mounting table by a predetermined amount in response to the detecting; and determining that the sheets have been stacked abnormally when the sensor is not in a non-detection state after the mounting table has been lowered by the predetermined amount.

Example embodiments include a non-transitory recording medium storing a plurality of instructions, which, when executed by one or more processors, causes the processors to perform a method of controlling a sheet stacking device, the sheet stacking device including a mounting table on which a pallet is mounted, the mounting table having a lift, the method including: detecting, by a sensor, at least one of an upper surface of sheets stacked on the pallet or an upper surface of the pallet, the sensor including light emitters and light receivers each arranged in the lateral direction of the sheet stacking device so as to face with each other; causing the lift to lower the mounting table by a predetermined amount in response to the detecting; and determining that the sheets have been stacked abnormally when the sensor is not in a non-detection state after the mounting table has been lowered by the predetermined amount.

BRIEF DESCRIPTION OF THE DRAWINGS

A more complete appreciation of embodiments of the present disclosure and many of the attendant advantages and features thereof can be readily obtained and understood from the following detailed description with reference to the accompanying drawings, wherein.

Figure 1A:
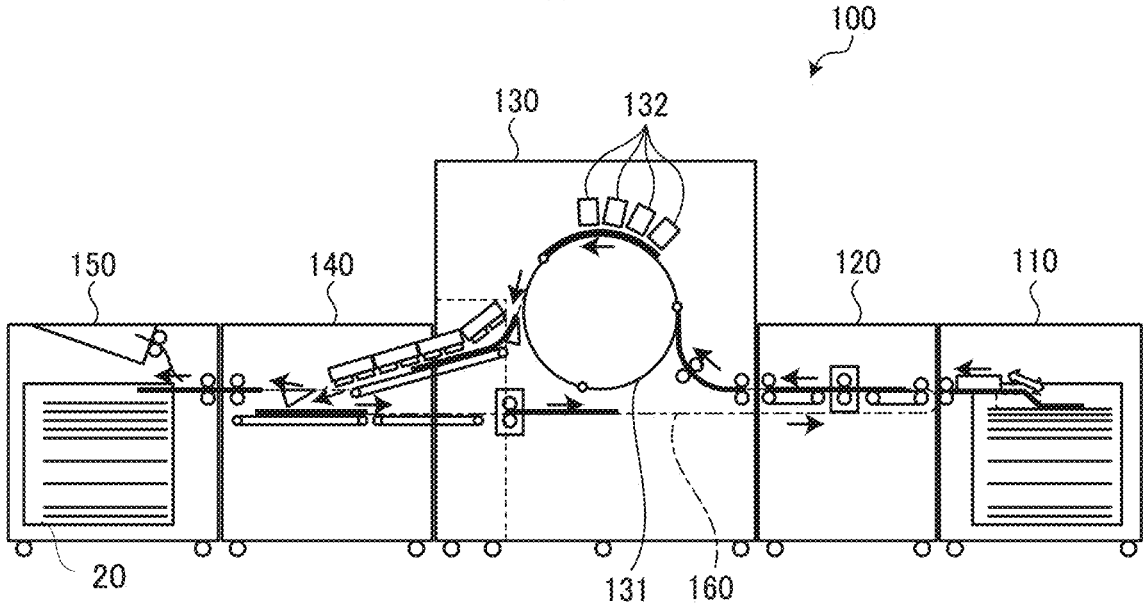
FIG. 1A is a schematic view of an inkjet image forming apparatus according to a first embodiment of the present disclosure, illustrating an overall configuration of the inkjet image forming apparatus.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

A sheet stacking device, an image forming apparatus, a control method, and a recording medium according to the embodiments of the present disclosure will be described in detail below with reference to the accompanying drawings.

First Embodiment

FIG. 1A is a schematic view of an inkjet image forming apparatus according to a first embodiment of the present disclosure, illustrating an overall configuration of the inkjet image forming apparatus. An example of the image forming apparatus including a sheet stacking device according to the present embodiment will be described with reference to FIG. 1A.

As illustrated in FIG. 1A, an inkjet image forming apparatus 100 includes a sheet feeding device 110, a sheet conveying device 120, an image forming device 130, a drying device 140, and a sheet ejecting device 150. A sheet-shaped material to be conveyed from the sheet feeding device 110, which functions as a sheet storage, is, for example, a sheet of paper (hereinafter referred to as a sheet).

The sheet conveying device 120 conveys a sheet to the image forming device 130. In the image forming device 130, the sheet is positioned on a cylindrical drum 131 and conveyed in an arrow direction illustrated in FIG. 1A as the cylindrical drum 131 rotates. The sheet is then conveyed at a predetermined timing to a position (a position at which an image is formed on the sheet) under each of liquid discharge heads 132, which discharge ink of respective colors. Specifically, each liquid discharge head 132 discharges ink of a corresponding one of the colors to the sheet so that an image is formed on a surface of the sheet.

The sheet having the image formed by the image forming device 130 is conveyed to the drying device 140, in which moisture in the ink on the surface of the sheet is evaporated. Subsequently, the sheet is conveyed to the sheet ejecting device 150, which functions as an ejecting device. The sheet ejecting device 150 ejects the sheet to a position where a user can take out the sheet.

Figure 1B:
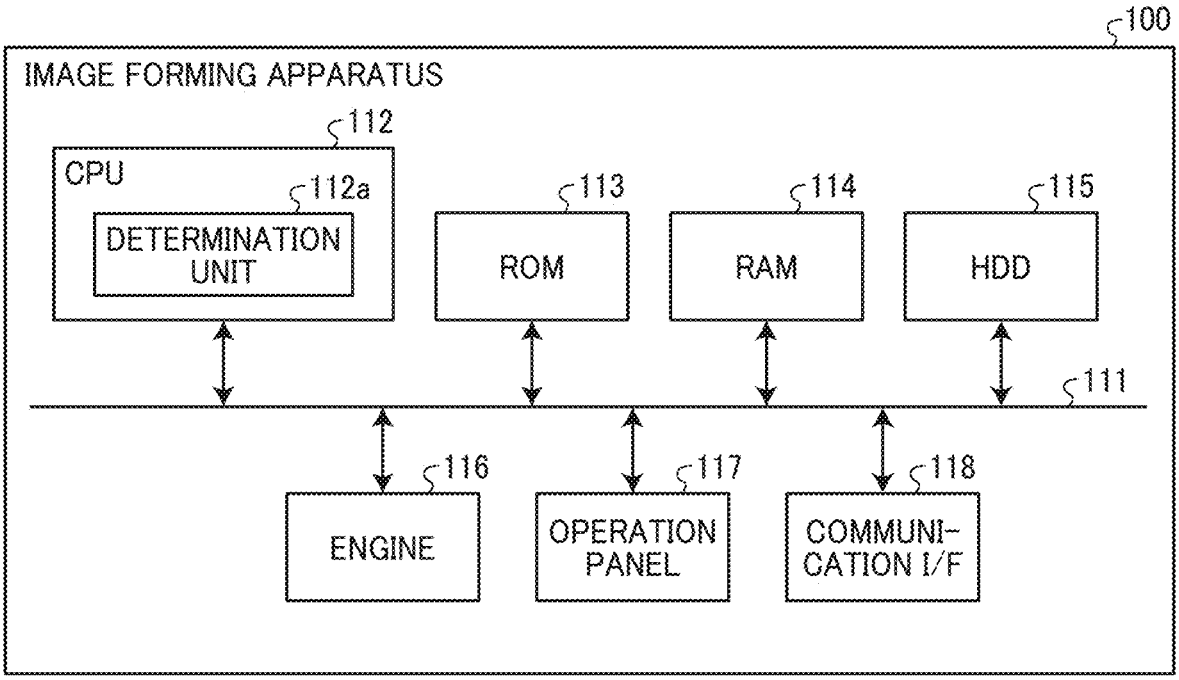
FIG. 1B is a block diagram illustrating a hardware configuration of the image forming apparatus according to the first embodiment.

FIG. 1B is a block diagram illustrating a hardware configuration of a controller of the image forming apparatus according to the first embodiment. The controller of the image forming apparatus 100 includes a central processing unit (CPU) 112, a read-only memory (ROM) 113, a random-access memory (RAM) 114, and a hard disk drive (HDD) 115. In place of the HDD 115, a storage device such as solid state drive (SSD) may be employed. The image forming apparatus 100 also includes an engine 116, an operation panel 117, and a communication interface (I/F) 118. These components are coupled to each other via a system bus 111.

The engine 116 is hardware that executes various functions such as a copier function, a scanner function, and a printer function and performs general-purpose information processing and processing other than communication to implement these functions. For example, the engine 116 includes a scanner that reads a document and a plotter that prints on a sheet material such as a sheet. The engine 116 may also include specific optional hardware such as a finisher that sorts printed sheet materials and an auto document feeder (ADF) that automatically feeds a document.

The CPU 112 comprehensively controls an operation of the image forming apparatus 100. The CPU 112 executes a program stored in, for example, the ROM 113 or the HDD 115 while using the RAM 114 as a work area. In this way, the CPU 112 controls the operation of the entire image forming apparatus 100. The CPU 112 causes the engine 116 to perform, for example, the scanner function and the printer function described above. In the present embodiment, the CPU 112 executes a program stored in, for example, the ROM 113 while using the RAM 114 as a work area to implement a determination unit 112*a*. A specific operation of the determination unit 112*a* will be described below.

The operation panel 117 receives various inputs in response to user operations and displays various images (screens). In the present embodiment, the operation panel 117 is a touch panel integrally including both a reception function that receives various inputs and a display function that displays various images (screens). However, the operation panel 117 is not limited to the touch panel. For example, the operation panel 117 may be implemented by two separate devices, that is, an input device that receives various inputs and a display device that displays various pieces of information.

The communication I/F 118 is an interface for communicating with an external device (e.g., a client terminal) via a network.

Figure 2B:
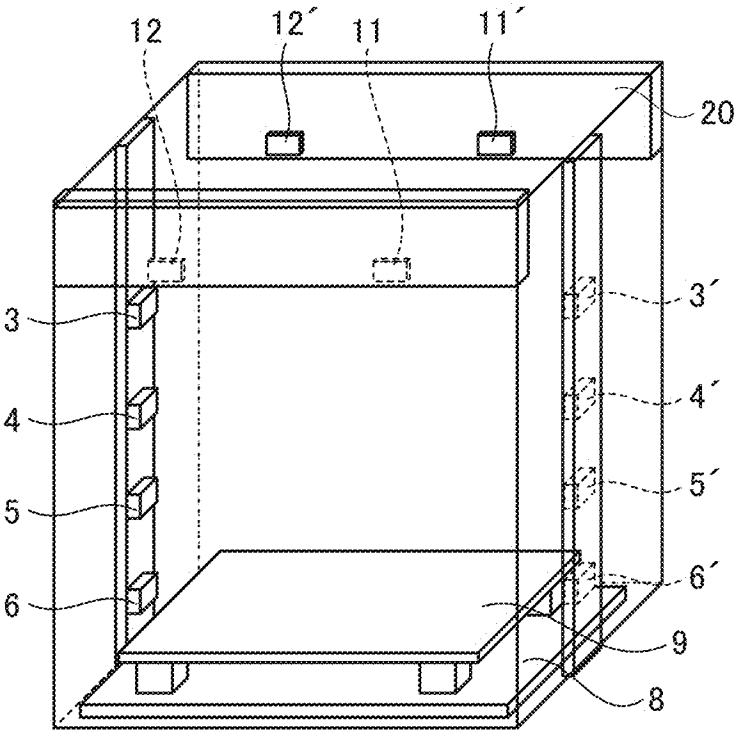
FIGS. 2A and 2B are schematic views of a sheet ejecting device of the image forming apparatus according to the first embodiment.
Figure 2A:
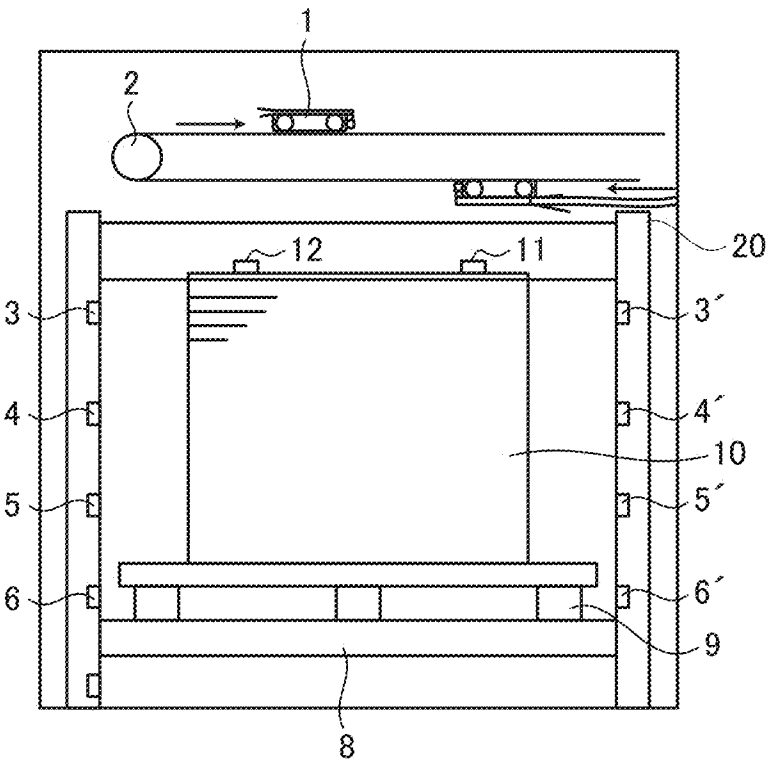

FIGS. 2A and 2B are schematic views of the sheet ejecting device 150 of the image forming apparatus 100 according to the first embodiment. The sheet ejecting device 150 illustrated as an example in FIGS. 2A and 2B includes a large-capacity stacker 20 that stacks sheets conveyed by a conveyance clip (pawl) 1 on a conveyance belt rotated by a conveyance roller 2.

As illustrated in FIGS. 2A and 2B, light transmissive sensors 3, 4, 5, and 6 are light emitters while light transmissive sensors 3', 4', 5', and 6' are light receivers that are arranged so as to face the light transmissive sensors 3, 4, 5, and 6, respectively. The light transmissive sensors serve as sensors that detect the position of sheets 10 or a pallet 9. Light transmissive sensors 11 and 12 are light emitters arranged in a lateral direction of the sheet ejecting device 150 (a lateral direction of a sheet 10), which is an example of the sheet stacking device. Light transmissive sensors 11' and 12' are light receivers arranged in the lateral direction of the sheet ejecting device 150 so as to face the light transmissive sensors 11 and 12, respectively. The light transmissive sensors 11, 11", 12, and 12' are sensors (examples of first sensors) that detect at least one of an upper surface of sheets 10 or an upper surface of the pallet 9. The sheets 10 are stacked on the pallet 9.

An example of an operation of the large-capacity stacker (the sheet ejecting device 150) will be described below. In the large-capacity stacker, a lift motor causes a lift table 8 to rise before printing starts, so that the pallet 9 moves to the standby position. In the present embodiment, the lift table 8 is an example of a mounting table on which the pallet 9 is mounted and has a lift including, for example, the lift motor. When the light transmissive sensors 11 and 11' or the light transmissive sensors 12 and 12' detect at least one of the upper surface of the pallet 9 or the upper surface of the stacked sheets 10, the CPU 112 controls the drive of the lift motor to stop raising the lift table 8 and start lowering the lift table 8. When the light transmissive sensors 11 and 11' and the light transmissive sensors 12 and 12' no longer detect the sheets 10 or the pallet 9, the CPU 112 causes the lift motor to stop and sets the position at that time as the standby position of the lift table 8.

Each of the sheets 10 printed by the image forming device 130, which is a sheet-fed press, is conveyed to an upper part of the sheet stacking device (the sheet ejecting device 150) by the conveyance clip 1. A sheet 10 that has fallen from the conveyance clip 1 is stacked on the pallet 9 with edges of the sheet 10 aligned by a sheet alignment mechanism. When the light transmissive sensors 11 and 11' or the light transmissive sensors 12 and 12' have been in a detection state for a predetermined time period $t_2$ or longer and therefore the CPU 112 determines that the stacked sheets 10 have reached the upper surface of the stacker 20 in the sheet ejecting device 150, the CPU 112 controls the lift motor to lower the lift table 8 by a predetermined amount x (mm). Note that the predetermined time period $t_2$ is a length of time longer than a time period $t_1$ during which a sheet 10 falls. The process described above is repeated until the light transmissive sensors detect that the sheets 10 have been stacked on the pallet 9 to the full capacity. As another example of the lowering operation, the lift table 8 may be lowered to the position at which the light transmissive sensors 11 and 11' and the light transmissive sensors 12 and 12' no longer detect the sheets 10 or the pallet 9.

Figure 3:
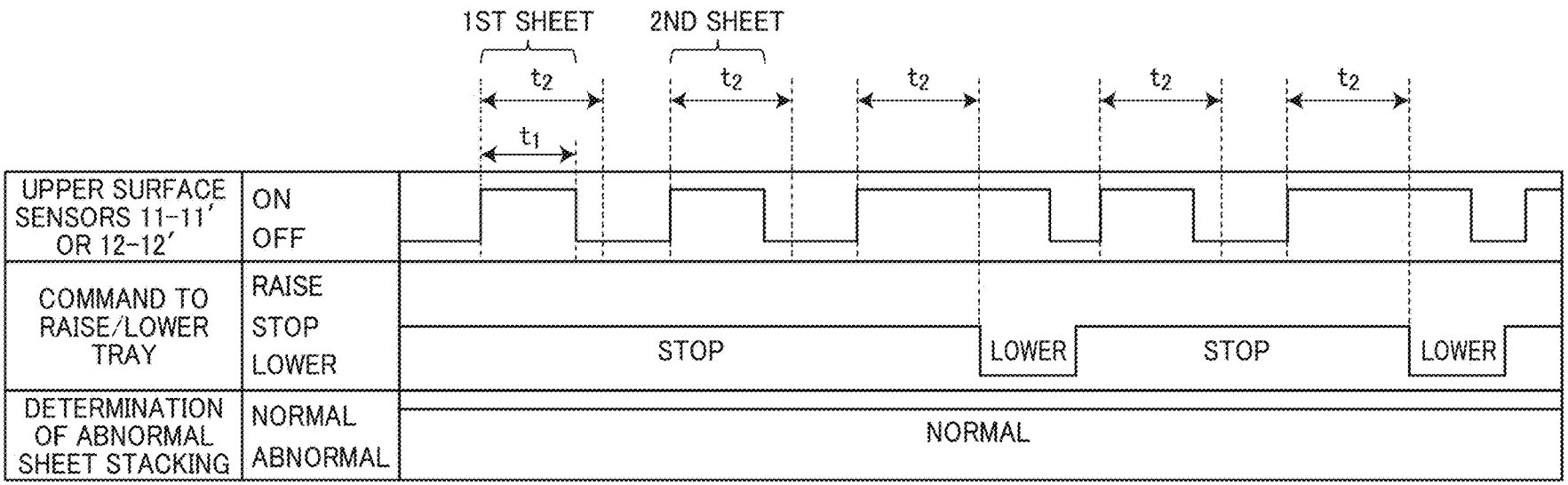
FIG. 3 is a diagram illustrating an example of a timing chart of an operation of a large-capacity stacker while printing is performed by the image forming apparatus according to the first embodiment.
Figure 4:
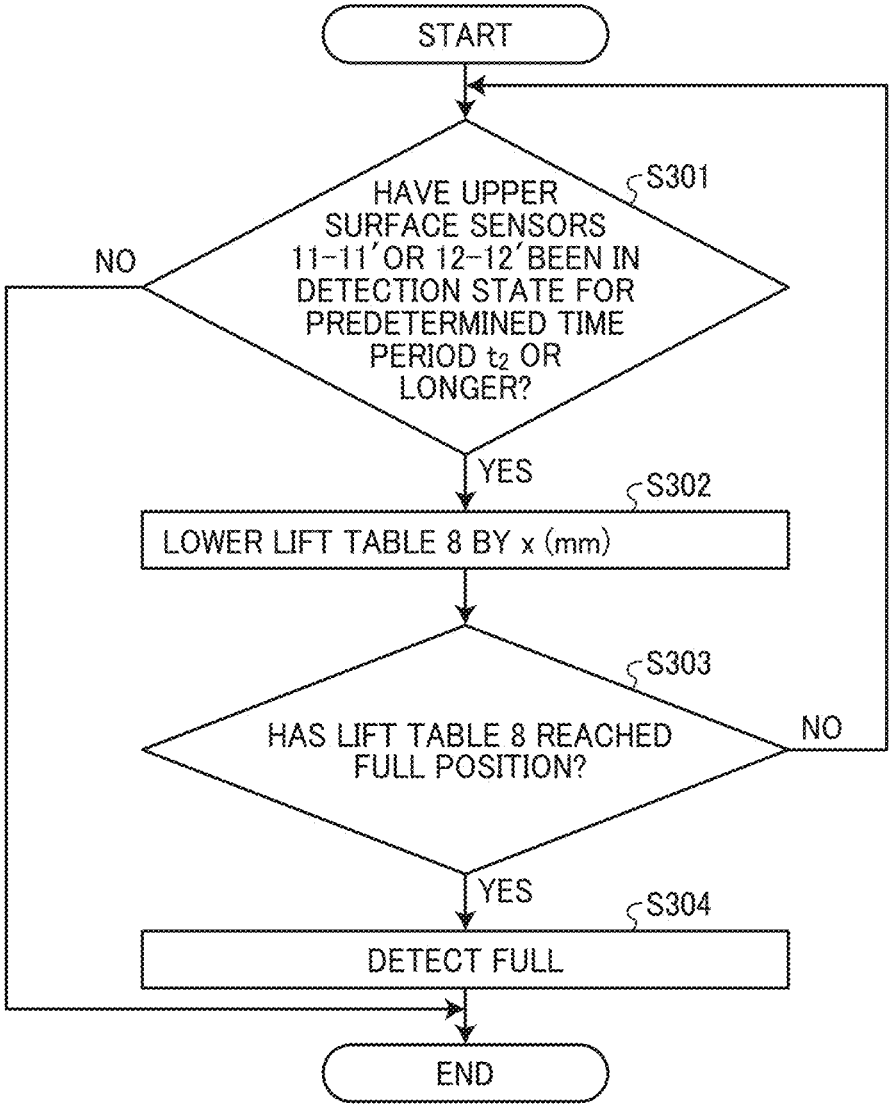
FIG. 4 is a flowchart illustrating an example of a flow of the operation of the large-capacity stacker while printing is performed by the image forming apparatus according to the first embodiment.

FIG. 3 is a diagram illustrating an example of a timing chart of the operation of the large-capacity stacker while printing is performed by the image forming apparatus 100 according to the first embodiment. FIG. 4 is a flowchart illustrating an example of a flow of the operation of the large-capacity stacker while printing is performed by the image forming apparatus 100 according to the first embodiment.

When a sheet 10 that has fallen from the conveyance clip 1 is stacked on the pallet 9, the determination unit 112*a* determines whether the light transmissive sensors (upper surface sensors) 11 and 11' or 12 and 12' have been in the detection state for the predetermined time period $t_2$ or longer (step S301). The detection state indicates, for example, a state in which the light transmissive sensors have detected at least one of the sheets 10 or the pallet 9 in a detectable area.

When the light transmissive sensors 11 and 11' or 12 and 12' have been in the detection state for the predetermined time period $t_2$ or longer (Yes at step S301), the determination unit 112*a* determines that the sheets 10 stacked on the pallet 9 have reached the upper surface of the stacker 20 in the sheet ejecting device 150. Then, the determination unit 112*a* causes the lift table (tray) 8 to be lowered by x millimeters (mm) (step S302). The determination unit 112*a* determines whether the lift table 8 has reached the full position at which the sheets 10 have been stacked on the pallet 9 to the full capacity (step S303). Here, the full position indicates the position close to the lower surface of the stacker 20 in the sheet ejecting device 150. For example, the full position is a position where the lift table 8 is not detectable by the light transmissive sensors 11 and 11' or 12 and 12'. When the lift table 8 has not reached the full position (No at step S303), the process returns to step S301.

When the lift table 8 has reached the full position (Yes at step S303), the determination unit 112*a* detects that the sheets 10 have been stacked to the full capacity (step S304) and ends the operation of stacking the sheets 10.

Figure 5:
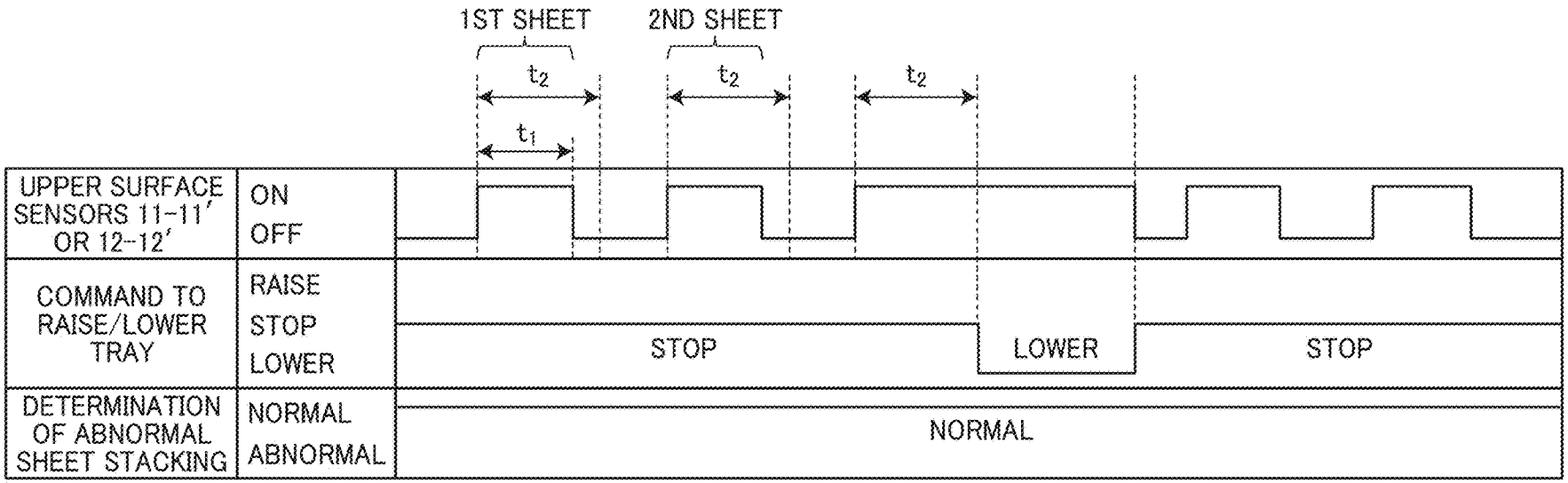
FIG. 5 is a diagram illustrating another example of the timing chart of the operation of the large-capacity stacker while printing is performed by the image forming apparatus according to the first embodiment.
Figure 6:
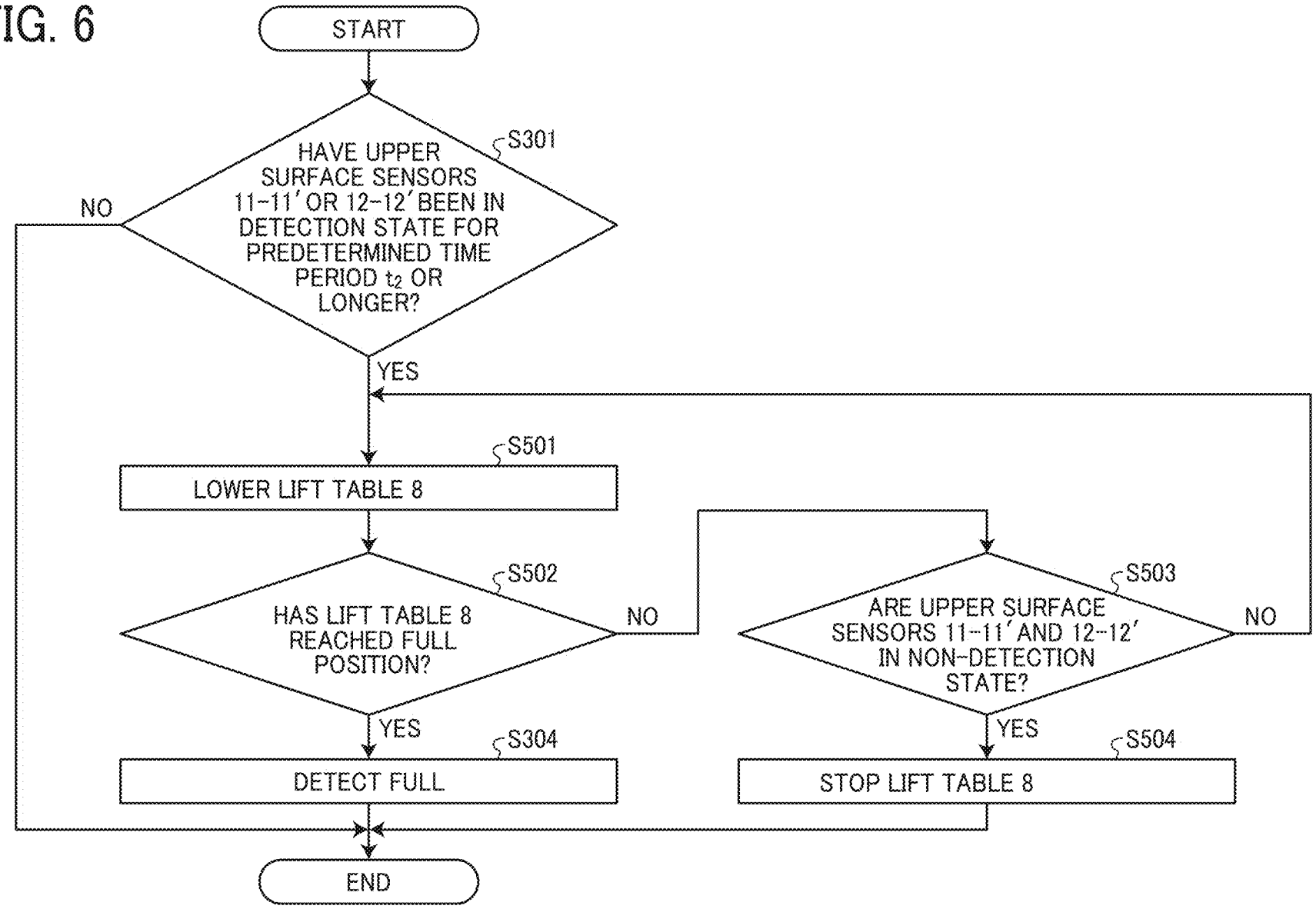
FIG. 6 is a flowchart illustrating another example of the flow of the operation of the large-capacity stacker while printing is performed by the image forming apparatus according to the first embodiment.

FIG. 5 is a diagram illustrating another example of the timing chart of the operation of the large-capacity stacker while printing is performed by the image forming apparatus 100 according to the first embodiment. FIG. 6 is a flowchart illustrating another example of the flow of the operation of the large-capacity stacker while printing is performed by the image forming apparatus 100 according to the first embodiment.

When a sheet 10 that has fallen from the conveyance clip 1 is stacked on the pallet 9, the determination unit 112*a* determines whether the light transmissive sensors (upper surface sensors) 11 and 11' or 12 and 12' have been in the detection state for the predetermined time period $t_2$ or longer (step S301).

When the light transmissive sensors 11 and 11' or 12 and 12' have been in the detection state for the predetermined time period $t_2$ or longer (Yes at step S301), the determination unit 112*a* determines that the sheets 10 stacked on the pallet 9 have reached the upper surface of the stacker 20 in the sheet ejecting device 150. Then, the determination unit 112*a* causes the lift table (tray) 8 to be lowered by x (mm) (step S501). The determination unit 112*a* determines whether the lift table 8 has reached the full position at which the sheets 10 have been stacked on the pallet 9 to the full capacity (step S502).

When the lift table 8 has not reached the full position (No at step S502), the determination unit 112*a* determines whether the light transmissive sensors 11, 11', 12, and 12' are in the non-detection state in which neither the sheets 10 nor the pallet 9 is detected (step S503). When the determination unit 112*a* determines that the light transmissive sensors 11, 11', 12, and 12' are not in the non-detection state (No at step S503), the process returns to step S501 and the determination unit 112*a* continues to lower the lift table 8.

When the light transmissive sensors 11, 11', 12, and 12' are in the non-detection state (Yes at step S503), the determination unit 112*a* stops lowering the lift table 8 (step S504) and ends the operation of stacking the sheets 10. When the lift table 8 has reached the full position (Yes at step S502), the determination unit 112*a* detects that the sheets 10 have been stacked to the full capacity (step S304) and ends the operation of stacking the sheets 10.

Figure 7:
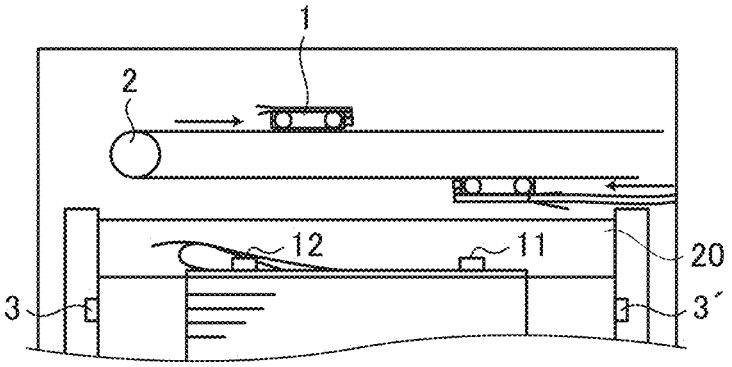
FIG. 7 is a partial view of the image forming apparatus according to the first embodiment, illustrating an example of a process of determining whether abnormal sheet stacking has occurred.

FIG. 7 is a partial view of the image forming apparatus 100 according to the first embodiment, illustrating an example of a process of determining whether abnormal sheet stacking has occurred. In the present embodiment, when the light transmissive sensors (upper surface sensors) 11 and 11' or 12 and 12' have detected at least one of the upper surface of sheets 10 or the upper surface of the pallet 9 and the lift table 8 has been lowered by the predetermined amount but the light transmissive sensors 11, 11', 12, and 12' are not in the non-detection state, the determination unit 112*a*, which functions as an example of a determination unit, determines that the sheets 10 have been stacked abnormally. Specifically, in addition to the above-described determination in the operation of stacking the sheets 10, the determination unit 112*a* determines whether the sheets 10 have been stacked abnormally based on a time period during which the lift table (tray) 8 has been lowered (or the number of times the lift table (tray) 8 has been lowered). With this configuration, the determination unit 112*a* can detect whether the sheets 10 have been stacked abnormally without requiring a large-scale function that causes range sensors to scan vertically and horizontally. In other words, abnormal sheet stacking can be detected without the need for additional components. This configuration can, therefore, prevent or minimize the expansion of the arrangement space and the increase of the cost.

For example, when the upper surface sensors (the light transmissive sensors 11 and 11' or 12 and 12') have detected one or more sheets 10 for the predetermined time period $t_2$ or longer and the lift table (tray) 8 has been lowered by the predetermined amount but the upper surface sensors are not in the non-detection state, the CPU 112 can determine that the sheets 10 have reached a position higher than expected. In this case, the determination unit 112*a* determines that abnormal sheet stacking such as a curled sheet has occurred as illustrated in FIG. 7 and stops conveying the sheets 10.

Figure 8:
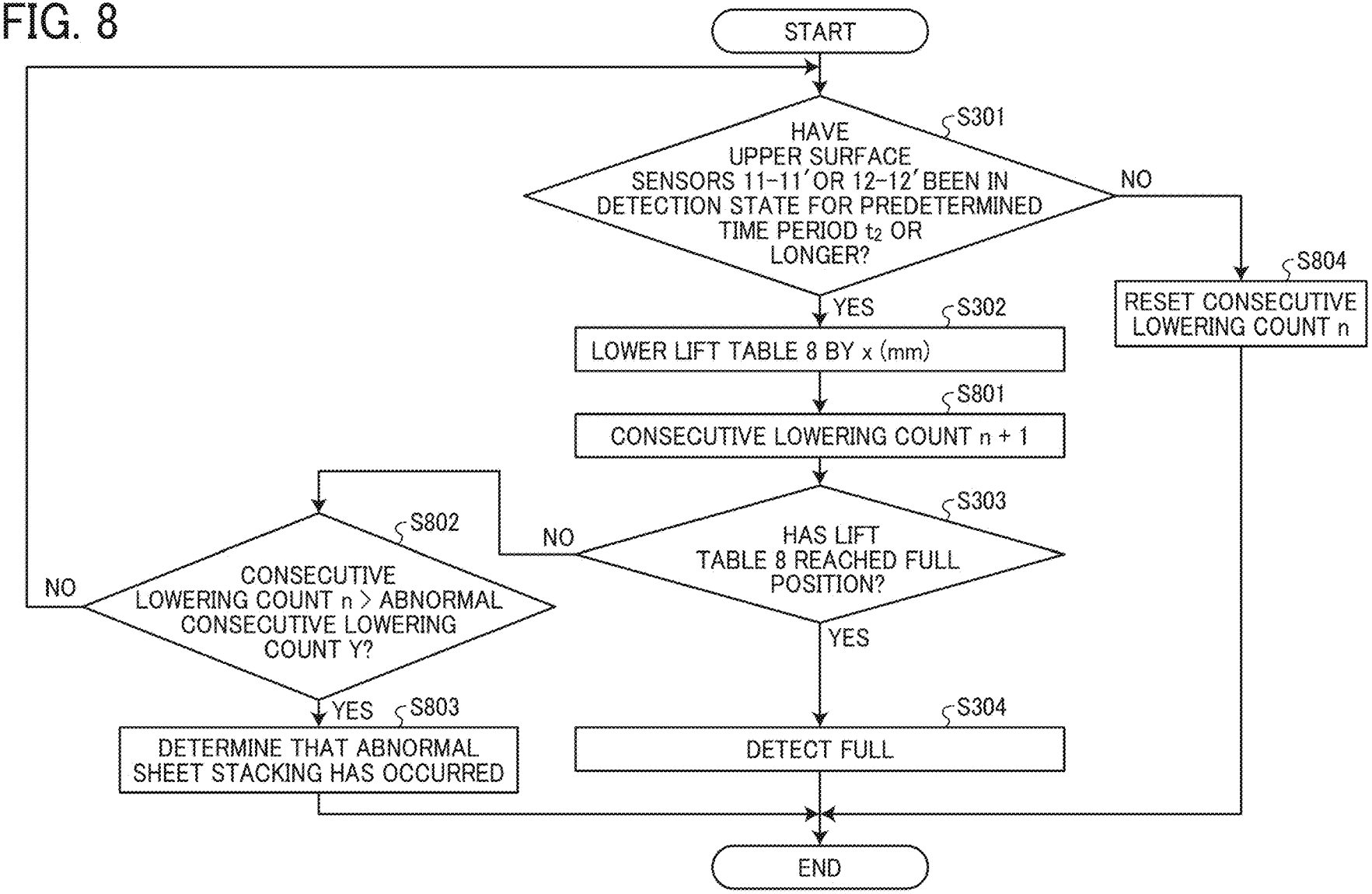
FIG. 8 is a flowchart illustrating an example of a flow of the process of determining whether abnormal sheet stacking has occurred in the image forming apparatus according to the first embodiment.

FIG. 8 is a flowchart illustrating an example of a flow of the process of determining whether abnormal sheet stacking has occurred in the image forming apparatus 100 according to the first embodiment. With reference to FIG. 8, an example of a method of determining whether abnormal sheet stacking has occurred in the stacking operation pattern illustrated in FIG. 3 will be described.

For this control, the determination unit 112*a* predetermines an abnormal consecutive lowering count Y. The abnormal consecutive lowering count Y serves as the threshold for the number of times the lift table 8 is lowered and when the number of times the lift table 8 has been lowered exceeds the abnormal consecutive lowering count Y, the determination unit 112*a* determines that the sheets 10 have been stacked abnormally. The amount of lowering of the lift table 8 at which the abnormal sheet stacking is determined to have occurred varies depending on the sheet type, the conveyance condition, and other factors. Therefore, the abnormal consecutive lowering count Y may be appropriately determined depending on the sheet type, the conveyance condition, and other factors. The abnormal consecutive lowering count Y is stored in a desired internal memory in advance.

As in the operation of the large-capacity stacker illustrated in FIG. 3, the printed sheets 10 are stacked on the pallet 9 while passing by the light transmissive sensors 11, 11', 12, and 12'. When the light transmissive sensors 11 and 11' or 12 and 12' have been in the detection state for the predetermined time period $t_2$ (which is a length of time longer than the time period $t_1$ it takes for a sheet 10 to fall) or longer (Yes at step S301), the determination unit 112*a* determines that the stacked sheets 10 have reached the upper surface of the stacker 20 in the sheet ejecting device 150 and causes the lift motor to lower the lift table 8 by the predetermined amount x (mm) (step S302). At this time, the determination unit 112*a* counts a consecutive lowering count n, which indicates the number of times the lift table 8 has been lowered consecutively (step S801).

Next, when the lift table 8 has not reached the full position (No at step S303), the determination unit 112*a* determines whether the consecutive lowering count n is greater than the abnormal consecutive lowering count Y (step S802). When the consecutive lowering count n is greater than the abnormal consecutive lowering count Y (Yes at step S802), the determination unit 112*a* determines that the sheets 10 have been stacked abnormally (step S803) and ends the operation of stacking the sheets 10. In other words, when at least one of the upper surface of the sheets 10 or the upper surface of the pallet 9 was detected and the lift table 8 has been lowered by the predetermined amount but the light transmissive sensors 11, 11', 12, and 12' are not in the detection state and the number of times the lift table 8 has been lowered (the consecutive lowering count n) is greater than the abnormal consecutive lowering count Y, the determination unit 112*a* determines that the sheets 10 have been stacked abnormally. When the consecutive lowering count n is equal to or smaller than the abnormal consecutive lowering count Y (No at step S802), the process returns to step S301.

When the light transmissive sensors 11 and 11' or 12 and 12' have not been in the detection state for the predetermined time period $t_2$ (which is a length of time longer than the time period $t_1$ it takes for a sheet 10 to fall) or longer (No at step S301), the determination unit 112*a* resets the consecutive lowering count n (step S804).

In this way, the image forming apparatus 100 according to the first embodiment can detect that the sheets 10 have been stacked abnormally without requiring a large-scale function that causes range sensors to scan vertically and horizontally. Therefore, the image forming apparatus 100 can detect abnormal sheet stacking without expanding the arrangement space or increasing the cost.

Second Embodiment

In a second embodiment of the present disclosure, the determination unit 112*a* determines that the abnormal sheet stacking has occurred, when at least one of the upper surface of sheets 10 or the upper surface of the pallet 9 was detected and the lift table 8 has been lowered by the predetermined amount but the upper surface sensors are not in the non-detection state and a time period during which the lift table 8 has been lowered exceeds an abnormal consecutive lowering time period. In the following description, the description of the identical or similar components to those of the first embodiment may be omitted.

In the present embodiment, the determination unit 112*a* determines that the sheets 10 have been stacked abnormally, when at least one of the upper surface of sheets 10 or the upper surface of the pallet 9 was detected and the lift table 8 has been lowered by the predetermined amount but the light transmissive sensors 11, 11', 12, and 12' are not in the non-detection state and a time period during which the lift table 8 has been lowered exceeds the abnormal consecutive lowering time period.

Figure 9:
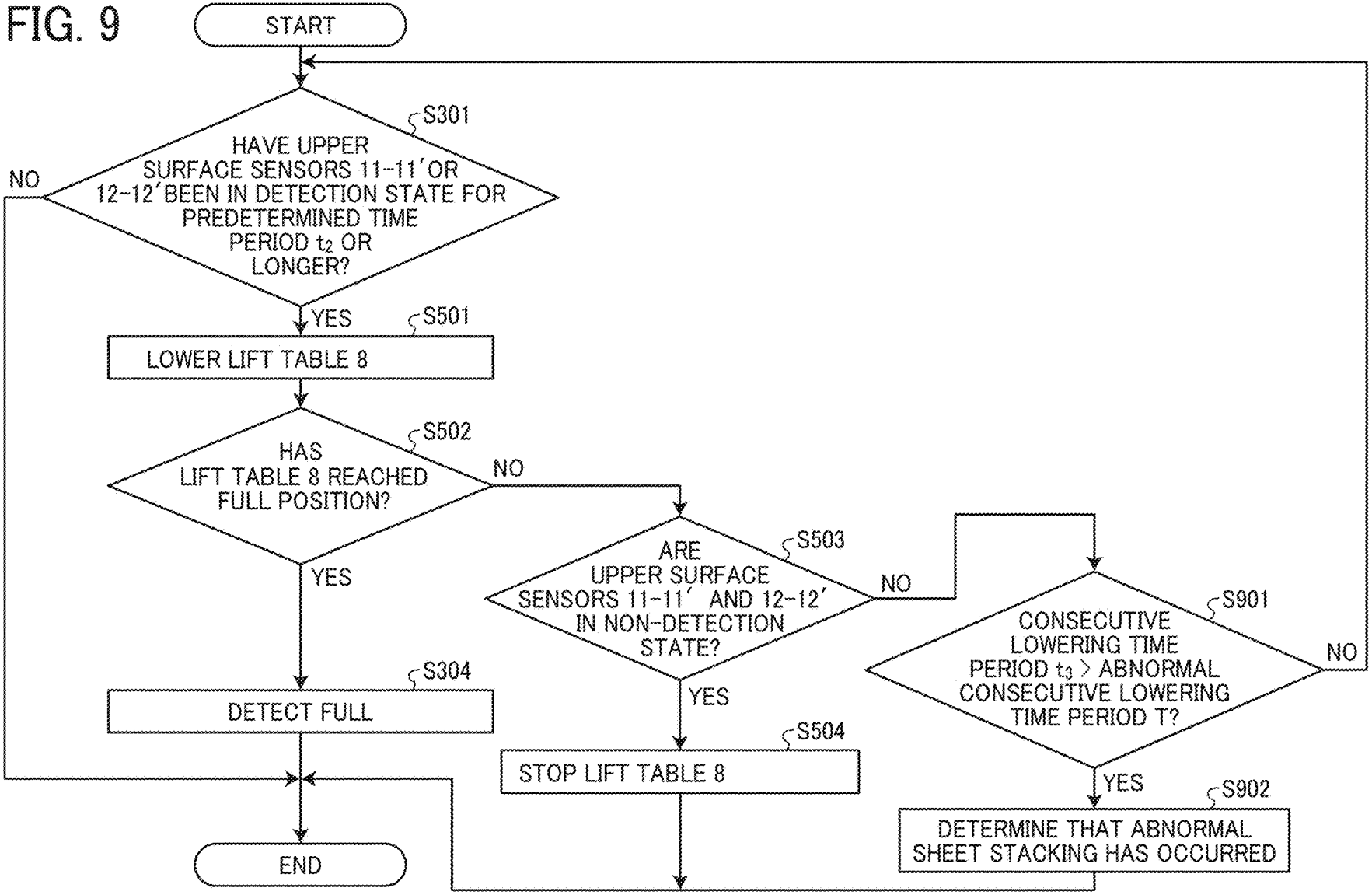
FIG. 9 is a flowchart illustrating an example of a flow of a process of determining whether abnormal sheet stacking has occurred in an image forming apparatus according to a second embodiment of the present disclosure.

FIG. 9 is a flowchart illustrating an example of a flow of a process of determining whether abnormal sheet stacking has occurred in the image forming apparatus 100 according to the second embodiment. For this control, the determination unit 112*a* predetermines an abnormal consecutive lowering time period T. The abnormal consecutive lowering time period T serves as the threshold for a lowering time period of the lift table 8 and when the time period during which the lift table 8 has been lowered exceeds the abnormal consecutive lowering time period T, the determination unit 112*a* determines that the sheets 10 have been stacked abnormally. The amount of lowering of the lift table 8 at which the abnormal sheet stacking is determined to have occurred varies depending on the sheet type, the conveyance condition, and other factors. Therefore, the abnormal consecutive lowering time period T may be appropriately determined depending on the sheet type, the conveyance condition, and other factors. The abnormal consecutive lowering time period T is stored in a desired internal memory in advance.

In determining whether the sheets 10 have been stacked abnormally using the light transmissive sensors 11, 11', 12, and 12', the determination unit 112*a* may, for each of at least one of conveyance media (in this example, the sheet types) or conveyance conditions of the sheets, adjust a time period during which the lift table 8 is lowered (consecutive lowering time period) or the number of times the lift table 8 is lowered (consecutive lowering count) until the determination unit 112*a* determines that the sheets 10 have been stacked abnormally. In other words, the amount of lowering of the lift table 8 at which the abnormal sheet stacking is determined to have occurred varies depending on the sheet type, the conveyance condition, and other factors. Therefore, the threshold (e.g., the abnormal consecutive lowering time period T) can be defined for each of various conditions so that false detection (erroneous determination) of the abnormal sheet stacking can be prevented.

As in the operation of the large-capacity stacker illustrated in FIG. 5, the printed sheets 10 are stacked on the pallet 9 while passing by the light transmissive sensors 11, 11', 12, and 12'. When the light transmissive sensors 11 and 11' or 12 and 12' have been in the detection state for the predetermined time period $t_2$ (which is a length of time longer than the time period $t_1$ it takes for a sheet 10 to fall) or longer (Yes at step S301), the determination unit 112*a* determines that the stacked sheets 10 have reached the upper surface of the stacker 10 in the sheet ejecting device 150 and causes the lift motor to lower the lift table 8 (step S501). While lowering the lift table 8, the determination unit 112*a* determines whether the lift table 8 has reached the full position (step S502).

When the lift table 8 has not reached the full position (No at step S502), the determination unit 112*a* determines whether the light transmissive sensors 11, 11', 12, and 12' are in the non-detection state (step S503). When the light transmissive sensors 11, 11', 12, and 12' are not in the non-detection state (No at step S503), the determination unit 112*a* causes the lift table 8 to be lowered to the position where the light transmissive sensors 11, 11', 12, and 12' are in the non-detection state.

At this time, the determination unit 112*a* determines whether a consecutive lowering time period $t_3$ is longer than the abnormal consecutive lowering time period T (step S901). When the consecutive lowering time period $t_3$ is longer than the abnormal consecutive lowering time period T (Yes at step S901), the determination unit 112*a* determines that the sheets 10 have been stacked abnormally (step S902). When the consecutive lowering time period $t_3$ is equal to or shorter than the abnormal consecutive lowering time period T (No at step S901), the process returns to step S301.

In this way, the amount of lowering of the lift table 8 at which the abnormal sheet stacking is determined to have occurred varies depending on the sheet type, the conveyance condition, and other factors. Therefore, in the image forming apparatus 100 according to the second embodiment, the threshold (e.g., the abnormal consecutive lowering time period T) can be defined for each of various conditions so that false detection (erroneous determination) of the abnormal sheet stacking can be prevented.

Third Embodiment

An image forming apparatus 100 according to a third embodiment includes excessive-rise detecting sensors including light emitters and light receivers disposed above the upper surface sensors. The light emitters are arranged in the lateral direction of the sheet ejecting device 150 and the light receivers are arranged in the lateral direction of the sheet ejecting device 150 such that the light emitters and the light receivers face each other. In the following description, the description of the identical or similar components to those of the first and second embodiments may be omitted.

Figure 10B:
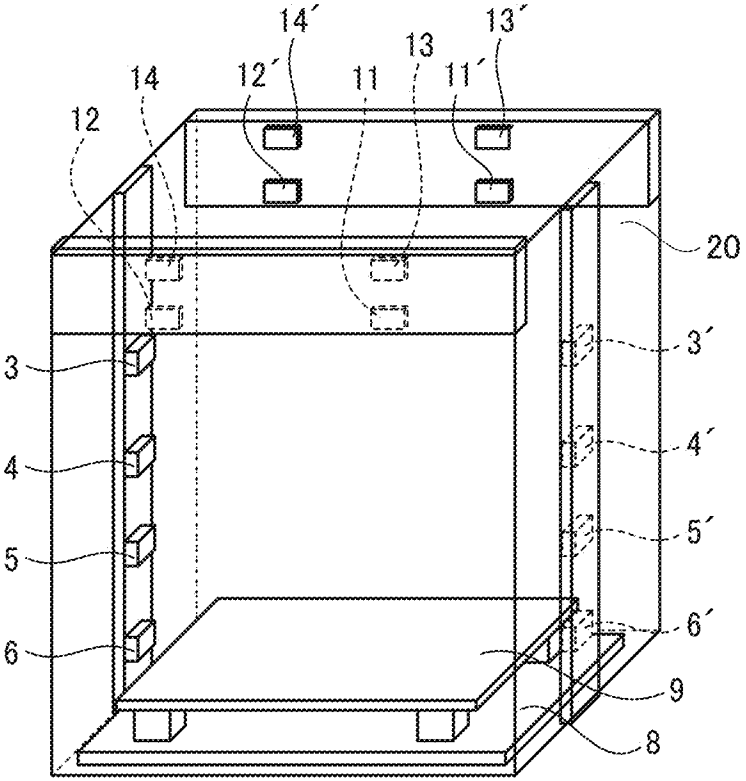
FIG. 10B is a perspective view of the sheet ejecting device illustrated in FIG. 10.
Figure 10A:
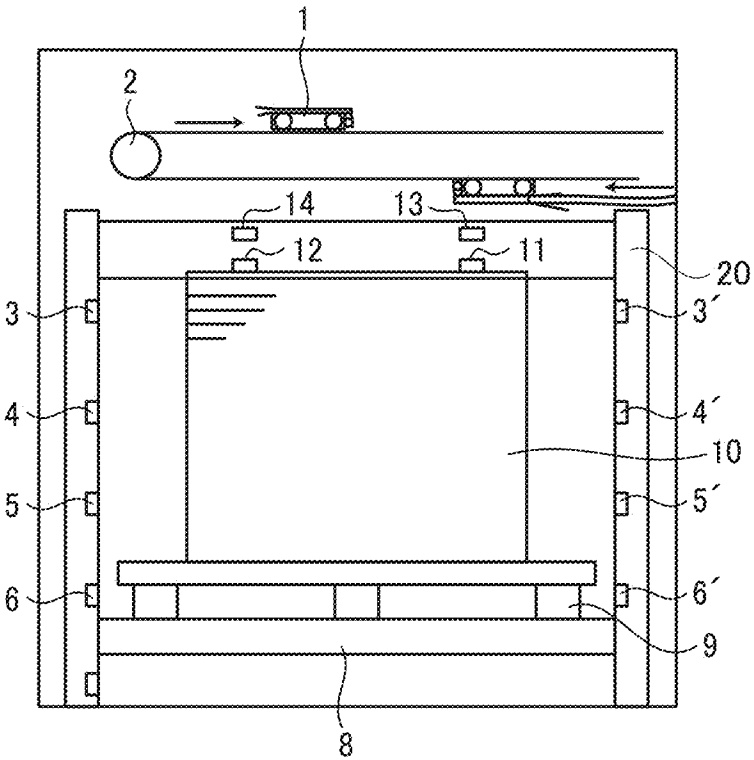
FIG. 10A is a schematic views of a sheet ejecting device of an image forming apparatus according to a third embodiment of the present disclosure.

FIGS. 10A and 10B are schematic views of a sheet ejecting device 150 of the image forming apparatus 100 according to the third embodiment. In the present embodiment, as illustrated in FIGS. 10A and 10B, the sheet ejecting device 150 includes light transmissive sensors (excessive-rise detecting sensors) 13, 13', 14, and 14' in addition to the components of the sheet ejecting device 150 according to the first and second embodiments. Specifically, the light transmissive sensors (excessive-rise detecting sensors) 13, 13', 14, and 14' are disposed above the upper surface sensors (light transmissive sensors) 11, 11', 12, and 12', respectively. The light transmissive sensors 13, 13', 14, and 14' are examples of second sensors including light emitters arranged in the lateral direction of the sheet ejecting device 150 and light receivers arranged in the lateral direction of the sheet ejecting device 150 such that the light emitters and the light receivers face each other. When the light transmissive sensors 13 and 13' or 14 and 14' have detected at least one of sheets 10 or the pallet 9 for a predetermined time period longer than the time period it takes for a sheet 10 to fall, the determination unit 112*a* determines that the sheets 10 have been stacked abnormally. With this configuration, the determination unit 112*a* can more accurately detect that the sheets 10 have been stacked abnormally. The light transmissive sensors 13, 13', 14, and 14' can also be used as the excessive-rise detecting sensors.

In determining whether the sheets 10 have been stacked abnormally using the light transmissive sensors 13, 13', 14, and 14', the determination unit 112*a* may, for each of at least one of conveyance media (in this example, the sheet types) or conveyance conditions of the sheets, adjust a time period during which the lift table 8 is lowered (consecutive lowering time period) or the number of times the lift table 8 is lowered (consecutive lowering count) until the determination unit 112*a* determines that the sheets 10 have been stacked abnormally. The amount of lowering of the lift table 8 at which the abnormal sheet stacking is determined to have occurred varies depending on the sheet type, the conveyance condition, and other factors. Therefore, the threshold (e.g., the abnormal consecutive lowering time period T) can be defined for each of various conditions so that false detection (erroneous determination) of the abnormal sheet stacking can be prevented.

Figure 11:
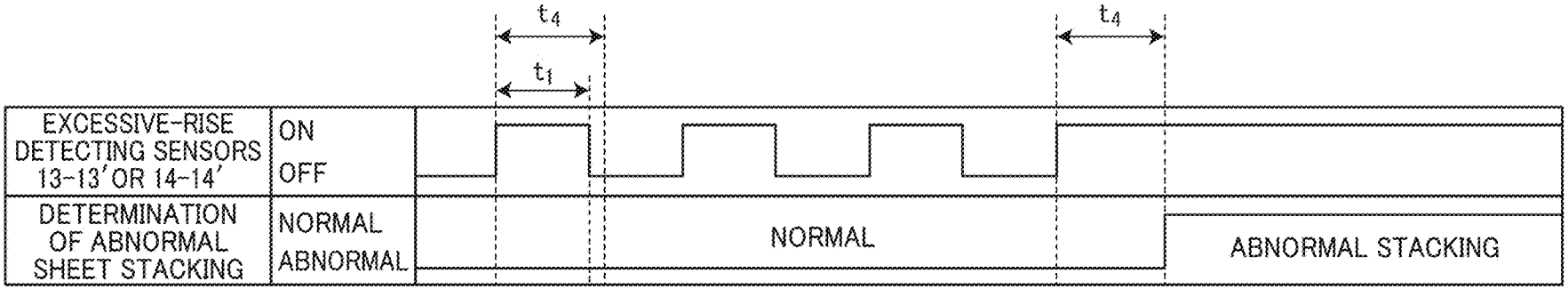
FIG. 11 is a diagram illustrating an example of a timing chart of a process of determining whether abnormal sheet stacking has occurred using excessive-rise detecting sensors in the image forming apparatus according to the third embodiment.
Figure 12:
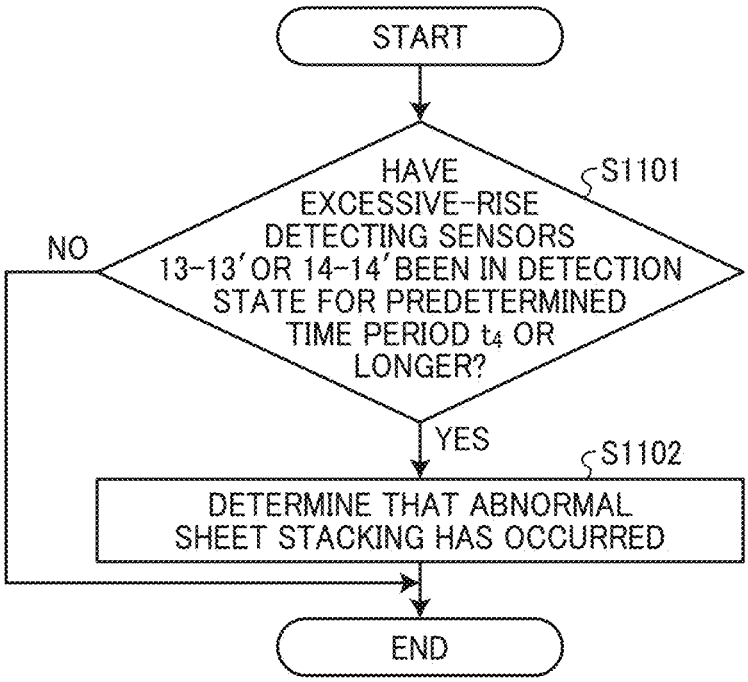
FIG. 12 is a flowchart illustrating an example of a flow of the process of determining whether abnormal sheet stacking has occurred using the excessive-rise detecting sensors in the image forming apparatus according to the third embodiment.

FIG. 11 is a diagram illustrating an example of a timing chart of a process of determining whether abnormal sheet stacking has occurred using the excessive-rise detecting sensors in the image forming apparatus 100 according to the third embodiment. FIG. 12 is a flowchart illustrating an example of a flow of the process of determining whether abnormal sheet stacking has occurred using the excessive-rise detecting sensors in the image forming apparatus 100 according to the third embodiment.

In the present embodiment, as illustrated in FIG. 11, the excessive-rise detecting sensors 13, 13', 14, and 14' do not detect a sheet 10 or the pallet 9 all the time during normal operation but repeat ON and OFF in response to the falling of each sheet 10. Therefore, when the excessive-rise detecting sensors 13 and 13' or 14 and 14' have detected at least one of the sheets 10 or the pallet 9 for a predetermined time period $t_4$ (which is a length of time longer than the time period $t_1$ during which a sheet 10 falls) or longer (Yes at step S1101), the determination unit 112*a* determines that the sheets 10 have been stacked abnormally (step S1102). When the time period during which at least one of the sheets 10 or the pallet 9 has been detected is equal to or shorter than the predetermined time period $t_4$, which is a length of time longer than the time period $t_1$ during which a sheet 10 falls (No at step S1101), the process ends.

In this way, the image forming apparatus 100 according to the third embodiment can reduce the risk of control failure because of its simplified process of determining whether the sheets 10 have been stacked abnormally. As described above, when the sheet materials have been stacked normally, the distance from the range sensors to an upper surface of stacked sheet materials is close to a theoretical value that has been calculated theoretically. However, when a sheet material is, for example, curled, the distance from the range sensors to the upper surface of the stacked sheet materials becomes abnormally small, resulting in a value that deviates significantly from the theoretical value.

For example, in the case of a technique additionally requiring a large-scale mechanism that causes range sensors to scan vertically and horizontally and such a large-scale mechanism may negatively affect not only securing of the arrangement space for the range sensors but also the cost of the mechanism significantly. Securing the arrangement space for the range sensors becomes even more difficult when clip conveyance is employed in a large-capacity stacker. This is because, in the clip conveyance, a clip conveyance mechanism is disposed on an upper part of the large-capacity stacker. Moreover, considering that the range sensors also detect a sheet material, such as a sheet, falling from a clip, when the range sensors detect a sheet in their vicinity, it may be difficult to determine whether the sheet is falling from the clip or curling of the sheet has occurred.

The sheet stacking device according to the first to third embodiments described above is capable of detecting abnormal sheet stacking without expanding the arrangement space or increasing the cost.

The program to be executed in the image forming apparatus 100 according to the first to third embodiments is installed in advance in, for example, the ROM 113 and provided. The program to be executed in the image forming apparatus 100 according to the first to third embodiments may be recorded on a computer-readable recording medium, such as a compact disc ROM (CD-ROM), a flexible disk (FD), a compact disc recordable (CD-R), or a digital versatile disc (DVD), in an installable or executable file format and provided.

The program to be executed by the image forming apparatus 100 according to the first to third embodiments may be stored in a computer connected to a network such as the Internet and may be made downloadable via the network when provided. The program to be executed by the image forming apparatus 100 according to the first to third embodiments may be provided or distributed via a network such as the Internet.

The program to be executed by the image forming apparatus 100 according to the first to third embodiments has a module configuration including the components (e.g., the determination unit 112*a*) described above. A processor such as the CPU 112, which is actual hardware, reads the program from the ROM 113 and executes the program, so that the components described above are loaded to a main storage device and the determination unit 112*a* is generated in the main storage device.

In the embodiments described above, the image forming apparatus according to the first to third embodiments is applied to a multifunction printer or multifunction peripheral including at least two of the copier function, the printer function, the scanner function, and the facsimile function. However, the image forming apparatus 100 according to the first to third embodiments is applicable to any of the image forming apparatuses such as a copier, a printer, a scanner, and a facsimile.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

Any one of the above-described operations may be performed in various other ways, for example, in an order different from the one described above.

The functionality of the elements disclosed herein may be implemented using circuitry or processing circuitry which includes general purpose processors, special purpose processors, integrated circuits, application specific integrated circuits (ASICs), digital signal processors (DSPs), field programmable gate arrays (FPGAs), conventional circuitry and/or combinations thereof which are configured or programmed to perform the disclosed functionality. Processors are considered processing circuitry or circuitry as they include transistors and other circuitry therein. In the disclosure, the circuitry, units, or means are hardware that carry out or are programmed to perform the recited functionality. The hardware may be any hardware disclosed herein or otherwise known which is programmed or configured to carry out the recited functionality. When the hardware is a processor which may be considered a type of circuitry, the circuitry, means, or units are a combination of hardware and software, the software being used to configure the hardware and/or processor.

The invention claimed is:

1. A sheet stacking device comprising:

a mounting table on which a pallet is mounted, the mounting table having a lift;

a sensor including:

light emitters and light receivers each arranged in the lateral direction of the sheet stacking device so as to face with each other the sensor to detect at least one of an upper surface of sheets stacked on the pallet or an upper surface of the pallet; and circuitry configured to cause the lift to lower the mounting table by a predetermined amount in response to the sensor detecting the at least one of the upper surface of the sheets or the upper surface of the pallet, and determine that the sheets have been stacked abnormally when the sensor is not in a non-detection state after the mounting table has been lowered by the predetermined amount.

2. The sheet stacking device according to claim 1, further comprising another sensor disposed above the sensor, said another sensor including light emitters arranged in the lateral direction of the sheet stacking device and light receivers arranged in the lateral direction of the sheet stacking device, the light emitters and the light receivers of said another sensor facing each other, wherein the circuitry is configured to determine that the sheets have been stacked abnormally when said another sensor has detected at least one of the sheets or the pallet for a predetermined time period longer than a time period during which a sheet falls.

3. The sheet stacking device according to claim 2, wherein, in determining whether the sheets have been stacked abnormally using one of the sensor and said another sensor, the circuitry is configured to, for each of at least one of conveyance media or conveyance conditions of the sheets, adjust a time period during which the mounting table is lowered until the circuitry determines that the sheets have been stacked abnormally.

4. The sheet stacking device according to claim 2, wherein, in determining whether the sheets have been stacked abnormally using one of the sensor and said another sensor, the circuitry is configured to, for each of at least one of conveyance media or conveyance conditions of the sheets, adjust a number of times the mounting table is lowered until the circuitry determines that the sheets have been stacked abnormally.

5. An image forming apparatus comprising:

the sheet stacking device according to claim 1; and an image forming device configured to form an image on a sheet.

6. A method of controlling a sheet stacking device, the sheet stacking device including a mounting table on which a pallet is mounted, the mounting table having a lift, the method comprising:

detecting, by a sensor, at least one of an upper surface of sheets stacked on the pallet or an upper surface of the pallet, the sensor including light emitters and light receivers each arranged in the lateral direction of the sheet stacking device so as to face with each other;

causing the lift to lower the mounting table by a predetermined amount in response to the detecting; and determining that the sheets have been stacked abnormally when the sensor is not in a non-detection state after the mounting table has been lowered by the predetermined amount.

7. A non-transitory recording medium storing a plurality of instructions, which, when executed by one or more processors, causes the processors to perform a method of controlling a sheet stacking device, the sheet stacking device including a mounting table on which a pallet is mounted, the mounting table having a lift, the method comprising:

detecting, by a sensor, at least one of an upper surface of sheets stacked on the pallet or an upper surface of the pallet, the sensor including light emitters and light receivers each arranged in the lateral direction of the sheet stacking device so as to face with each other;

causing the lift to lower the mounting table by a predetermined amount in response to the detecting; and determining that the sheets have been stacked abnormally when the sensor is not in a non-detection state after the mounting table has been lowered by the predetermined amount.

* * * * *